United States Patent [19]

Dutcher

[11] Patent Number: 4,925,404

[45] Date of Patent: May 15, 1990

[54] ENVIRONMENTALLY PROTECTED EMI SHIELDED CONNECTOR

[75] Inventor: Clinton H. Dutcher, Camarillo, Calif.

[73] Assignee: G & H Technology, Inc., Camarillo, Calif.

[21] Appl. No.: 451,572

[22] Filed: Dec. 18, 1989

Related U.S. Application Data

[63] Continuation of Ser. No. 257,650, Oct. 14, 1988, abandoned.

[51] Int. Cl.[5] ..... H01R 13/648

[52] U.S. Cl. ..... 439/607; 439/610; 439/551; 439/271; 439/95

[58] Field of Search ..... 439/607, 608, 609, 610, 439/551, 92, 95, 96, 98, 108, 278, 283, 271, 272, 277, 578–585

[56] References Cited

U.S. PATENT DOCUMENTS

| | | | |
|---|---|---|---|
| 2,863,132 | 12/1958 | Sowa | 439/730 |
| 3,128,138 | 4/1964 | Noschese | 439/579 |
| 3,366,920 | 1/1968 | Lauclig et al. | 439/581 |
| 3,391,381 | 7/1968 | Livingston | 439/610 |
| 3,832,675 | 8/1974 | Detemple et al. | 439/277 |
| 3,963,295 | 6/1976 | Askman et al. | 439/276 |
| 3,990,765 | 11/1976 | Hill | 439/610 |
| 4,195,902 | 4/1980 | Caveney et al. | 439/730 |
| 4,233,731 | 11/1980 | Clabburn et al. | 439/932 X |
| 4,330,166 | 5/1982 | Cooper et al. | 439/609 |
| 4,428,639 | 1/1984 | Hillis | 439/609 |
| 4,464,540 | 8/1984 | Reeder | 439/610 |
| 4,468,080 | 8/1984 | Van Brunt | 439/610 |
| 4,470,657 | 9/1984 | Deacon | 439/609 |
| 4,493,525 | 1/1985 | Hall et al. | 439/610 |
| 4,531,790 | 7/1985 | Selvin | 439/92 |
| 4,579,415 | 4/1986 | Van Brunt et al. | 439/608 |
| 4,611,873 | 9/1986 | Punako et al. | 439/607 X |
| 4,640,569 | 2/1987 | Dola et al. | 439/610 X |
| 4,671,586 | 6/1987 | DeBolt | 439/607 |
| 4,678,260 | 7/1987 | Galluser et al. | 439/607 |
| 4,702,710 | 10/1987 | Dittman et al. | 439/271 |

*Primary Examiner*—Neil Abrams
*Assistant Examiner*—Khiem Nguyen
*Attorney, Agent, or Firm*—Kenneth J. Hovet

[57] ABSTRACT

An EMI shielded connector is provided having an exterior receptacle shell, plug housing and coupling member constructed of plastic. Metallic sleeves line the shell and housing interiors and enclose insert assemblies. The sleeves are releasably engaged at a joint connection to provided electrical continuity through the connector for EMI protection. A junction means may be used to enhance electrical communication at the joint connection and a sealing member is used for environmental protection of the connector interior parts.

20 Claims, 3 Drawing Sheets

ENVIRONMENTALLY PROTECTED EMI SHIELDED CONNECTOR

This is a continuation of application Ser. No. 07/257,650 filed Oct. 14, 1988, now abandoned.

BACKGROUND OF THE INVENTION

1. Field of the Invention

The invention relates to electrical connectors and, more particularly, to EMI shielded connectors which include protection against harsh corrosive conditions.

2. Description of the Prior Art

Effective connectors should be mechanically strong, light weight, low cost, corrosion resistant and display high levels of EMI shielding. In general, good EMI shielding comes from metals. Aluminum and its alloys have always been good choices because they are lightweight, highly conductive and readily machined into parts. Unfortunately, aluminum is also chemically reactive and is prone to significantly corrode in harsh environments.

Because of the above problems, composite plastic materials have been employed to form the connector housing. Since plastic is non-conductive, fillers were used to provide some degree of EMI shielding. Great difficulty was incurred, however, in creating a sufficiently homogenous mixture of filler to provide effective shielding. This was because molding processes do not allow the necessary even distribution and physical contact between filler particles for achieving the desired overall conductivity.

An alternative to the composite plastic approach is shown in U.S. Pat. No. 4,678,260. Here, a foraminous sleeve of metal or wire mesh is embedded in the molded plastic housing. A portion of the sleeve is exposed to provide contact with other conductive parts which lead to a ground plane.

Difficulty with this approach is that sleeve openings or mesh size directly affect the frequency level of EMI that can be effectively attenuated. Such a restriction greatly limits the usefulness of the device.

SUMMARY OF THE INVENTION

The present invention provides a connector that comprises interfitting plastic shell, housing and coupling parts. The parts sealingly enclose an insert assembly and provide a connector housing that is lightweight, durable and impervious to harsh corrosive environments. Each housing and shell part includes an inner metallic sleeve which releasably join together and form a shield against electromagnetic interference (EMI). Different junction means and shielded cable attachment means are adapted for use with the metallic sleeves.

DESCRIPTION OF THE PREFERRED EMBODIMENTS

Figure 1:
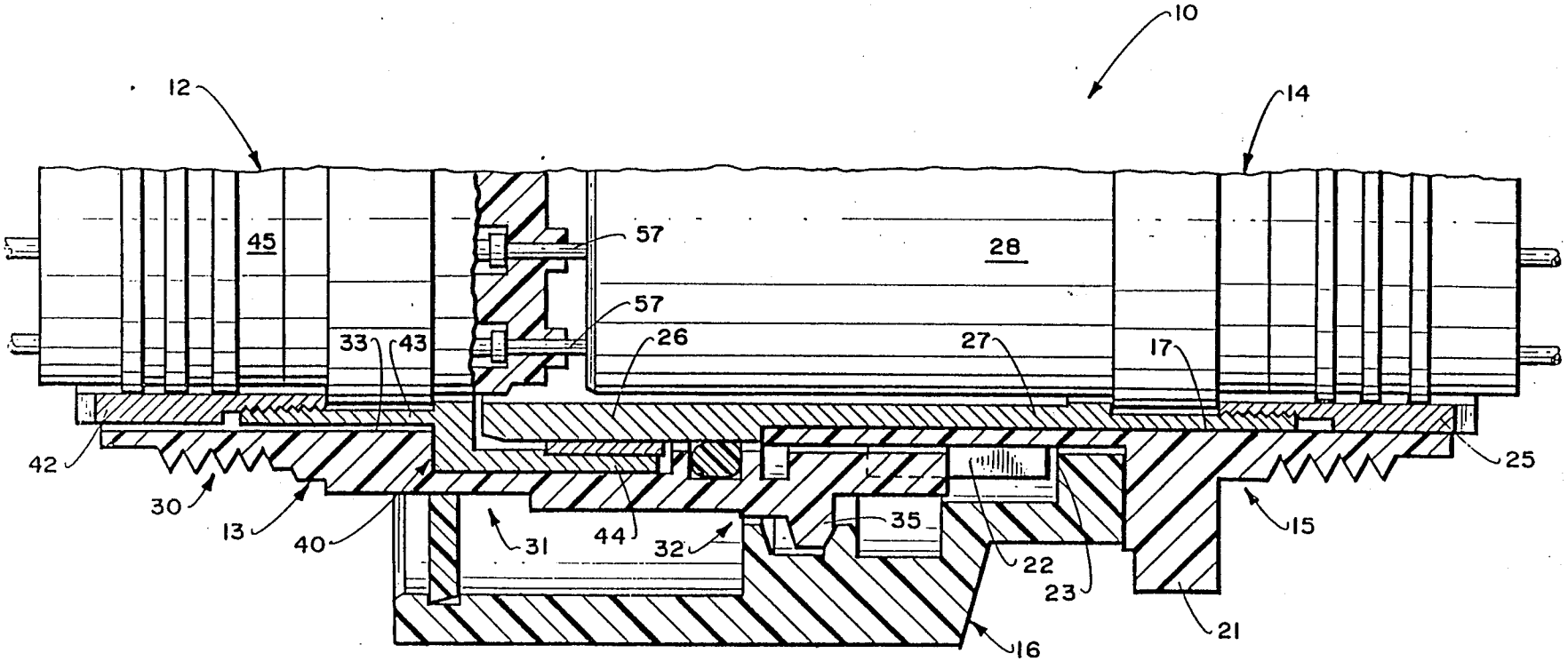
FIG. 1 is a fragmentary cross-sectional view showing the plug housing and receptacle shell assemblies of the invention connected together.
Figure 2:
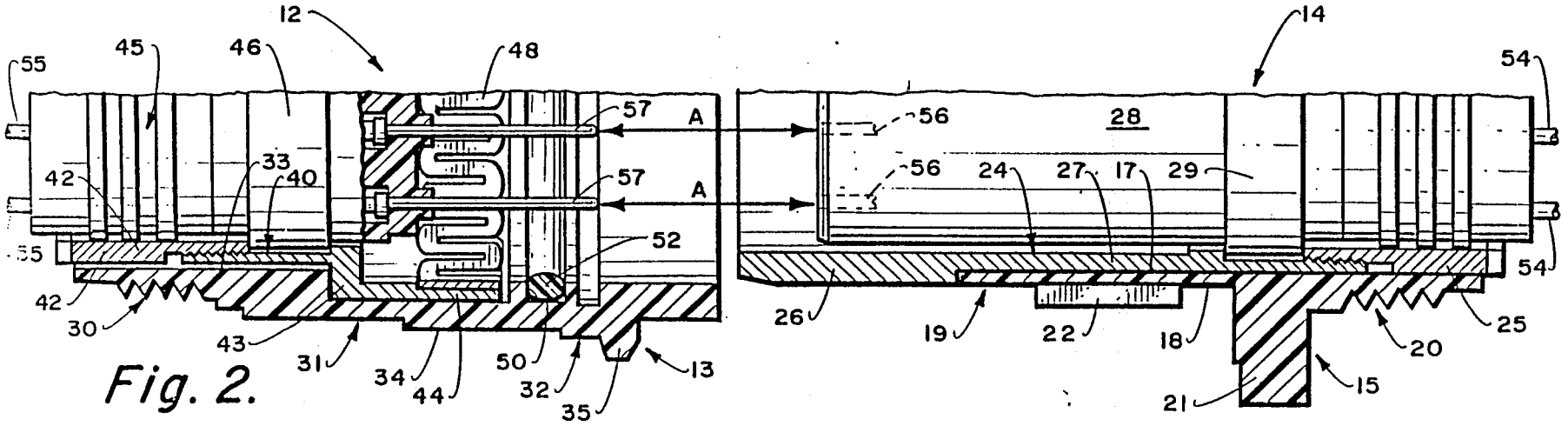
FIG. 2 is a fragmentary cross-sectional view showing the assemblies of FIG. 1 separated from each other.

With particular reference to FIGS. 1 and 2 of the drawings, the overall connector of the invention is shown by reference 10. The connector is preferably tubular in shape and consists of a plug assembly 12 and a shell assembly 14. Both assemblies releasably interfit with each other and are secured together with a coupling member 16. The housing assembly consists of a plug insert 45 enclosed by a plug housing 13 and the shell assembly consists of a shell insert 28 enclosed by a receptacle shell 15.

The receptacle shell is defined by an inner surface 17, an outer surface 18 with an inner end portion 19 and an outer end portion 20. The outer surface may include an outer flange 21 for use in attaching the shell to a cabinet panel or other grounded external support structure. It also includes one or more bosses 22 for connection with lip 23 of coupling member 16 for securing together the shell and plug assemblies.

The plug housing, receptacle shell and coupling member are constructed of a dielectric material such as plastic. This permits the use of low cost high volume manufacturing processes such as injection molding.

Located adjacent the shell inner surface is an electrically conductive shell sleeve 24. The shell sleeve includes an outer part 25 proximate outer end portion 20 and extends inwardly to a shell joint part 26. The shell joint part extends beyond the end of inner end portion 19.

The shell sleeve is constructed of metal and provides a generally uniform interior diameter for enclosing shell insert 28. As shown, outer part 25 is threadably attached to the shell sleeve main body 27 to facilitate securement by abutment with insert rib member 29.

The plug housing 13 is defined by an outer end 30, a midportion 31 and an inner end 32. It includes a plug inner surface 33 and an exterior surface 34. The exterior surface provides plug thread means 35 for engagement with corresponding means on coupling member 16.

Positioned adjacent plug inner surface 33 is an electrically conductive plug sleeve 40. The plug sleeve provides a generally uniform interior diameter for enclosing plug insert 45. It includes a forward section 42 which is proximate outer end 30 and extends inwardly to a plug joint section 44 proximate the housing midportion 31. In the same manner as with the shell sleeve, forward section 42 may be threadably attached to plug sleeve main body 43. This provides a convenient mean for securement of plug insert 45 via abutment with insert rib 46.

When the plug housing and receptacle shell are connected, a joint is formed between the shell joint part 26 and plug joint section 44. This provides electrical communication between the respective sleeves and shields the insert assemblies from EMI. The joint connection shown in the drawings may be referenced as a lap joint, but other joint connections known in the art may be used such as bayonet, twist lock, threads and the like.

With reference to the joint shown in FIGS. 1 and 2, the plug housing inner surface 33 is offset radially outward proximate midportion 31. This accomodates a similar offset in plug sleeve 40 and allows the plug joint section to have a diameter greater than shell joint part 26. Note that the shell joint part extends axially from the sleeve main body with only a minor radially outward enlargment at its free end. As such, when the plug and receptacle assemblies are moved together, shown by arrows A in FIG. 2, the shell joint part, will slide over and overlap the plug joint section.

To help insure good electrical communication at the joint connection, a junction means may be used. This may comprise an electrically conductive ring member overlying at least a portion of the plug joint section. As shown, the ring member comprises a metallic spring washer 48 forming an annular interface between the plug joint section and shell joint part.

The plug housing inner surface 33 further includes an annular recess 50 located outwardly from adjacent the joint connection and proximate inner end 32. The recess is adapted to accomodate a resilient environmental sealing member shown as O-ring 52. The sealing member is sized to resiliently engage the outer surface of shell joint part 26 to prevent unwanted contamination of the assembled parts.

In a manner known in the art, the insert assemblies primarily comprise a plastic body containing pin or socket contacts for terminating wires from cables. As shown, shell insert 28 terminates wires 54 which are in electrical communication with socket contacts 56. Plug insert 45 terminates wires 55 which electrically communicate with pin contacts 57. The pin contacts engage the socket contacts providing electrical continuity through the connector.

Figure 3:
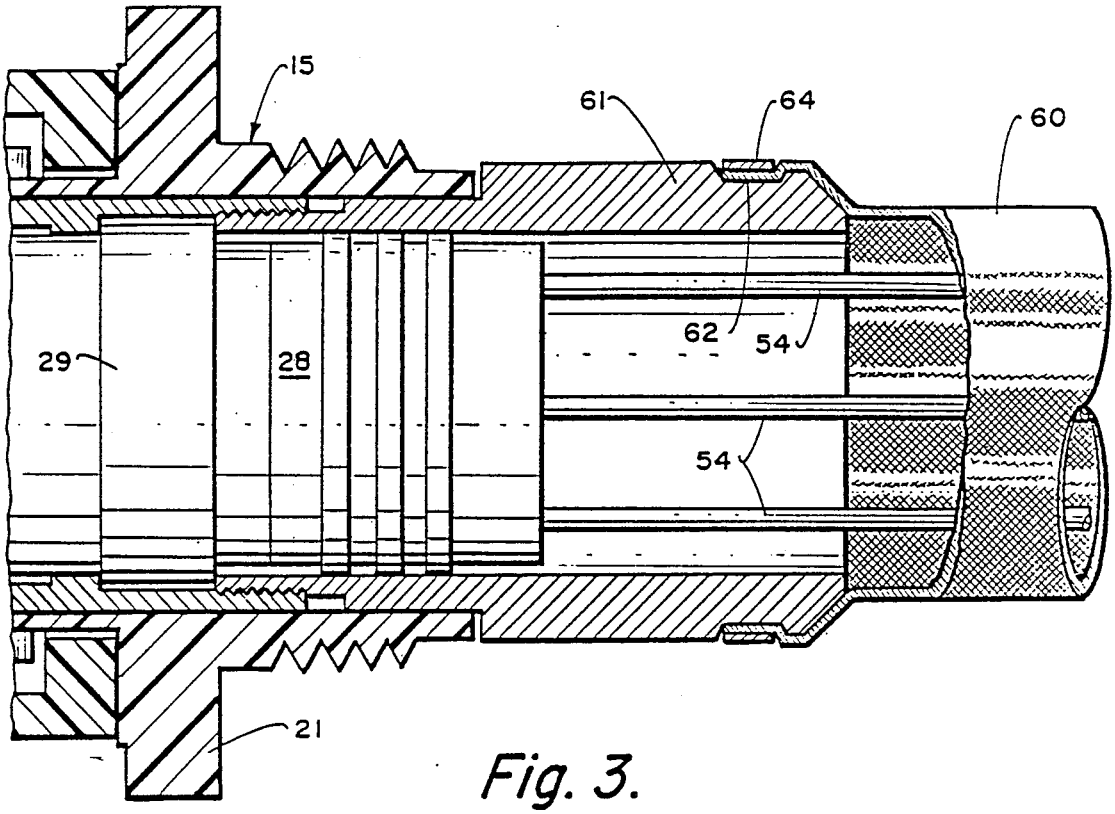
FIG. 3 is a fragmentary cross-sectional view showing an alternative shielded cable connection to a modified receptacle shell assembly.

If the wires are assembled within a grounded outer conductive sheath for EMI protection, the sheath must be electrically connected to the sleeves of the plug housing and receptacle shell. As shown in FIG. 3, braided metal sheath 60 engages extended shell sleeve outer part 61. The sheath end overlies annular notch 62 and is secured therein by clamping means shown as shrink band 64. An identical arrangement is used to secure a grounded conductive sheath around plug wires 55 to an extended plug sleeve forward section (not shown). Other sheath connection means may be used such as those shown in U.S. Pat. Nos. 4,579,415 and 4,468,080 which are herein incorporated by reference.

Figure 4:
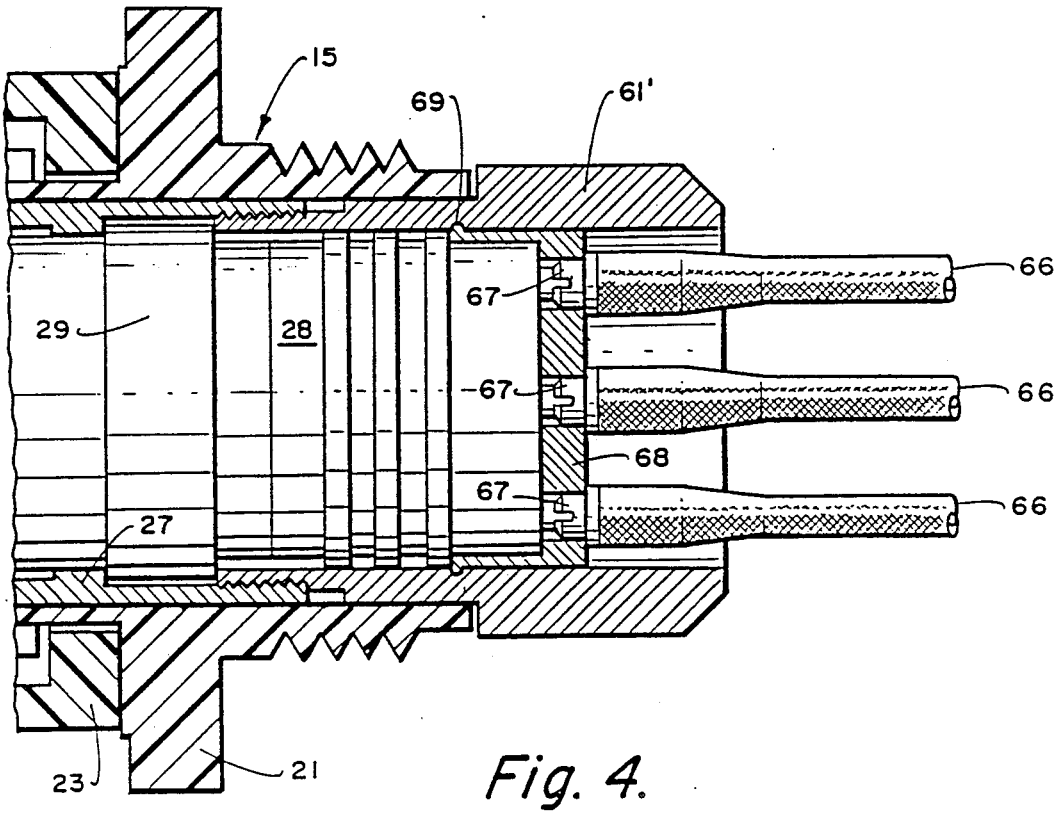
FIG. 4 is a view similar to FIG. 3 showing a second alternative shielded cable connection.

With reference to FIG. 4, individual wires are shown as being protected with electrically conductive sheathes 66. In this case, each sheath is terminated with an insert part 67 which, in turn, engages corresponding openings in a ground plane shown as shell plate 68. The plate overlies the outer face of shell insert 28 and is in electrical communication with extended shell sleeve outer part 61'. The shell plate is retained within the shell sleeve by leg projections 69 which frictionally engage corresponding grooves about the interior surface of outer part 61'. A plug face plate grounding plane identically arranged is utilized with the plug housing outer end. The combined face plates and sleeves provide continuous EMI shielding throughout the overall connector and wire connections.

Figure 5:
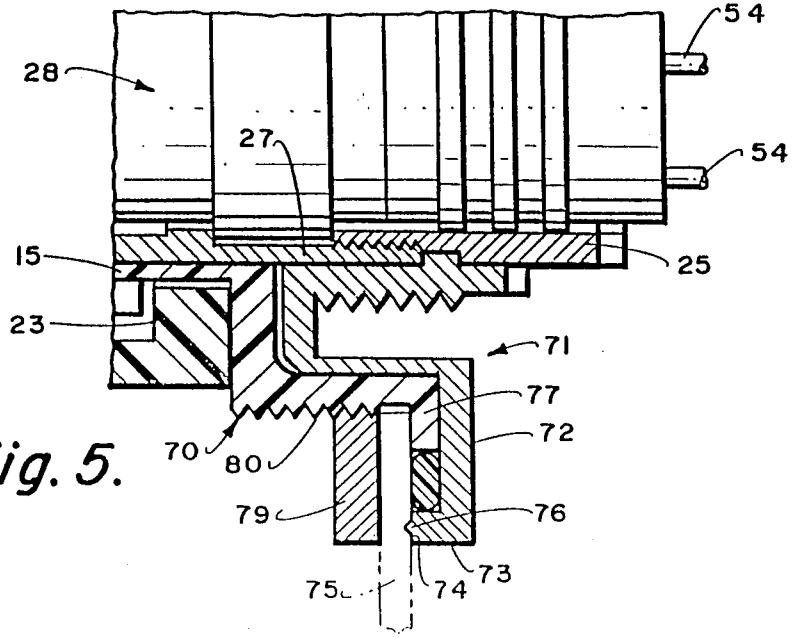
FIG. 5 is a fragmentary cross-sectional view showing a receptacle shell grounded to a panel.

FIG. 5 depicts grounding of the shell sleeve to an external support structure. This is accomplished with a grounding panel engagement means shown as jam-nut connector 71. The connector is constructed of conductive material and includes an inner ring portion that directly engages the shell sleeve parts. Spaced outwardly is an integral radial flange 72 having an outer annular lip 73. The lip has an end face 74 that engages bulkhead panel 75 and provides electrical communication from the receptacle shell to the grounded panel. Optionally, the end face may include one or more scratch points 76 to help insure electrical contact with the panel.

In place of outer flange 21, receptacle shell 15 is modified to coact with the jam-nut connector by providing an outer retainer section 70. This section includes a distal flange 77 which is spaced from lip 73 to allow for placement of a panel O-ring seal 78. The retainer section is plastic and generally overlies the metal jam-nut connector for environmental protection. Jam-nut 79 engages threads 80 and functions to secure the overall assembly to the bulkhead panel.

In addition to the above-described embodiment, it will be appreciated that other panel engagement means could be used. For example, simple wires, conductive strips, metal plating on the shell receptacle exterior or conductors embedded within the molded shell receptacle could function to provide a grounding path from the shell sleeves.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. In an EMI shielded electrical connector that terminates EMI shielded wires, wherein the improvement comprises:

a plug housing constructed of a dielectric material having an outer end, a midportion and an inner end, said housing including a plug inner surface and a plug exterior surface;

an electrically conductive plug sleeve located adjacent said inner surface having a forward section extending from proximate said outer end to a plug joint section proximate said midportion;

a receptacle shell constructed of dielectric material adapted for releasable connection with said plug housing having an outer end portion and an inner end portion with a shell inner surface and shell outer surface; and, an electrically conductive shell sleeve located adjacent said shell inner surface having an outer part extending from proximate said outer end portion to a shell joint part extending beyond said inner end portion, said shell joint part and said plug joint section forming a joint connection at a location proximate said plug housing midportion when said plug housing and receptacle shell are engaged.

2. The connector of claim 1 including a junction means forming an electrically conductive interface between said plug joint section and said shell joint part.

3. The connector of claim 2 wherein said plug joint section and said shell joint part form an overlapping joint with said junction means.

4. The connector of claim 3 wherein said junction means comprises a metallic ring member.

5. The connector of claim 1 wherein said plug housing inner surface includes an annular recess proximate said inner end, said recess containing a sealing member for engagement with said shell joint part.

6. The connector of claim 1 including a plug ground plane in electrical communication with said plug sleeve and a shell ground plane in electrical communication with said shell sleeve.

7. The connector of claim 1 wherein said receptacle shell is provided with a grounding panel engagement means for mounting said receptacle shell to a grounded external support structure, said grounding panel engagement means being electrically coupled to said shell sleeve.

8. The connector of claim 7 wherein said engagement means comprises a jam-nut connector interconnecting said shell sleeve and said support structure.

9. The electrical connector of claim 1 wherein said plug sleeve is offset radially outward proximate said midportion.

10. The electrical connector of claim 1 wherein said outer part is separable from said shell sleeve and said forward section is separable from said plug sleeve.

11. An electrical connector comprising a plastic receptacle shell releasably engaged with a plastic plug housing, said housing having an outer end, a midportion and an inner end, said receptacle shell having an outer end portion and an inner end portion, said housing and shell each enclosing an insert containing means for terminating one or more cables, said shell having an inner metallic shell sleeve that includes a shell joint part extending beyond said inner end portion, said housing having an inner metallic plug sleeve with a plug joint section located proximate said midportion, said sleeves being engaged at a joint connection proximate said midportion.

12. The connector of claim 11 wherein said joint connection includes a junction means forming an electrical interface between said sleeves.

13. The connector of claim 11 wherein said cables include an outer metallic sheath and each of said inserts are provided with a grounding plate for interconnecting said sheath with a respective metallic sleeve.

14. The connector of claim 11 wherein said receptacle shell includes a grounding engagement means for coupling said metallic shell sleeve to an external support structure.

15. The connector of claim 12 including a sealing member positioned adjacent said junction means.

16. The electrical connector of claim 11 wherein said shell sleeve includes an outer part proximate said outer end portion and said plug housing includes a forward section proximate said outer end.

17. The electrical connector of claim 16 wherein said outer part is separable from said shell sleeve and said forward section is separable from said plug sleeve.

18. The electrical connector of claim 17 wherein each of said inserts includes a rib for abutment with a respective forward section or outer part.

19. In an EMI shielded electrical connector that terminates EMI shielded wires, wherein the improvement comprises:

a plug housing constructed of a dielectric material having an outer end, a midportion and an inner end, said housing including a plug inner surface and a plug exterior surface;

an electrically conductive plug sleeve located adjacent said inner surface having a forward section extending from proximate said outer end to a plug joint section proximate said midportion;

a receptacle shell constructed of dielectric material adapted for engagement with said plug housing having an outer end portion and an inner end portion with a shell inner surface and shell outer surface; and, an electrically conductive shell sleeve located adjacent said shell inner surface having an outer part extending from proximate said outer end portion to a shell joint part, said shell joint part and said plug joint section forming a joint connection at a location proximate said plug housing midportion when said plug housing and receptacle shell are engaged, said receptacle shell having a grounding panel engagement means for mounting said receptacle shell to a grounded external support structure, said grounding panel engagement means being electrically coupled to said shell sleeve.

20. An electrical connector comprising a plastic receptacle shell releasably engaged with a plastic plug housing, said housing having an outer end, a midportion and an inner end, said receptacle shell having an outer end portion and an inner end portion, said housing and shell each enclosing an insert containing means for terminating one or more cables, said shell having an inner metallic shell sleeve that includes a shell joint part, said housing having an inner metallic plug sleeve with a plug joint section located proximate said midportion, said sleeves being engaged at a joint connection proximate said midportion, said receptacle shell including a grounding engagement means for coupling said metallic shell sleeve to an external support structure.

* * * * *